US010850816B2

(12) United States Patent
Schmidt et al.

(10) Patent No.: US 10,850,816 B2
(45) Date of Patent: Dec. 1, 2020

(54) STAND UP PADDLE BOARD WITH WINDOW AND LIGHTS

(71) Applicant: LightSUP Boards, LLC, Kamuela, HI (US)

(72) Inventors: Raymond Daniel Kaualani Schmidt, Kamuela, HI (US); Kelly Faith Nedved, Kamuela, HI (US)

(73) Assignee: LIGHTSUP BOARDS, LLC, Kamuela, HI (US)

( * ) Notice: Subject to any disclaimer, the term of this patent is extended or adjusted under 35 U.S.C. 154(b) by 0 days.

(21) Appl. No.: 16/442,224

(22) Filed: Jun. 14, 2019

(65) Prior Publication Data

US 2020/0189702 A1 Jun. 18, 2020

Related U.S. Application Data

(63) Continuation-in-part of application No. 29/690,697, filed on May 9, 2019.

(60) Provisional application No. 62/670,342, filed on May 11, 2018.

(51) Int. Cl.
*B63C 11/49* (2006.01)
*B63B 32/57* (2020.01)

(52) U.S. Cl.
CPC ..... *B63C 11/49* (2013.01); *B63B 32/57* (2020.02)

(58) Field of Classification Search
CPC ..... B63C 11/49; B63B 32/57
See application file for complete search history.

(56) References Cited

U.S. PATENT DOCUMENTS

| | | | |
|---|---|---|---|
| D233,904 | S | 12/1974 | Dage |
| 4,691,658 | A | 9/1987 | New et al. |
| D295,279 | S | 4/1988 | Diamond |
| 4,925,417 | A | 5/1990 | Warren |

(Continued)

FOREIGN PATENT DOCUMENTS

| | | | |
|---|---|---|---|
| EP | 0396829 | A1 | 11/1990 |
| GB | 1397456 | A | 6/1975 |

(Continued)

OTHER PUBLICATIONS

U.S. Appl. No. 29/690,697, Office Action, dated Apr. 24, 2020, pp. 1-18.

*Primary Examiner* — S. Joseph Morano
*Assistant Examiner* — Jovon E Hayes
(74) *Attorney, Agent, or Firm* — Kunzler Bean & Adamson; Bruce R. Needham

(57) ABSTRACT

An apparatus for viewing marine life is disclosed. The apparatus includes a board configured to float on water and a window positioned in an opening in the board. The opening in a front end of the board and the window includes a transparent top portion, a transparent bottom pane and sides forming a center void. The window is sealed to prevent water from entering the void and the window includes a bottom lip planar with the transparent bottom pane. The apparatus includes a seal positioned in a gap between the window and the opening in the board and above the lip. The seal is inserted from a top surface of the board and provides a friction fit between the window and the opening. The seal includes a flexible resilient material and sized for a friction fit between the opening and the window to prevent movement of the window.

20 Claims, 5 Drawing Sheets

(56) References Cited

U.S. PATENT DOCUMENTS

| | | | | | |
|---|---|---|---|---|---|
| D349,935 | S | | 8/1994 | Simonson | |
| 5,337,692 | A | * | 8/1994 | Troiani | B63C 11/49 114/357 |
| 5,447,459 | A | | 9/1995 | Hammond | |
| 5,454,743 | A | | 10/1995 | Simonson | |
| D377,072 | S | * | 12/1996 | Ilejay | D21/769 |
| 5,672,082 | A | * | 9/1997 | Binder | B63C 11/49 441/135 |
| 6,033,276 | A | * | 3/2000 | Han | B63C 11/49 114/315 |
| 6,068,531 | A | | 5/2000 | Patterson | |
| D427,441 | S | | 7/2000 | Prescott | |
| 6,572,424 | B2 | | 6/2003 | Harkrider | |
| 6,656,005 | B2 | | 12/2003 | Meyerhoffer | |
| RE38,467 | E | * | 3/2004 | Lincoln | B63B 32/50 D21/769 |
| D503,206 | S | | 3/2005 | Debold | |
| 7,507,132 | B2 | * | 3/2009 | Grune | B63B 32/50 441/65 |
| 7,731,554 | B2 | * | 6/2010 | Grune | B63B 43/00 441/65 |
| 7,811,144 | B2 | * | 10/2010 | Cavanaugh | B63B 32/50 441/80 |
| D674,452 | S | | 1/2013 | Figler et al. | |
| 9,327,807 | B1 | | 5/2016 | Masson et al. | |
| 9,516,949 | B2 | | 12/2016 | Harkrider | |
| D785,738 | S | | 5/2017 | McKellar et al. | |
| D860,367 | S | | 9/2019 | Barrett et al. | |
| 10,421,527 | B2 | | 9/2019 | MeKellar et al. | |
| 2002/0115366 | A1 | | 8/2002 | Harkrider | |
| 2006/0016379 | A1 | * | 1/2006 | Wescombe-Down | A01K 79/02 114/221 R |
| 2010/0003875 | A1 | * | 1/2010 | Cavanaugh | B63B 45/04 441/80 |
| 2013/0065465 | A1 | * | 3/2013 | Montana | B63C 11/49 441/135 |
| 2015/0133011 | A1 | | 5/2015 | Imparato | |
| 2016/0096598 | A1 | * | 4/2016 | Harkrider | B63B 7/08 441/130 |

FOREIGN PATENT DOCUMENTS

| | | | |
|---|---|---|---|
| GB | 2165186 | A | 4/1986 |
| GB | 2336132 | A | 10/1999 |

* cited by examiner

Top

Bottom

Side

Cross Section A-A'

Partial Cross Section B-B'

Cross Section B-B'

Cross Section C-C'

Partial Cross Section A-A'

STAND UP PADDLE BOARD WITH WINDOW AND LIGHTS

CROSS-REFERENCES TO RELATED APPLICATIONS

This application claims the benefit of U.S. Provisional Patent Application No. 62/670,342 entitled "STAND UP PADDLEBOARD WITH VIEWING PORT" and filed on May 11, 2018 for Raymond Daniel Kaualani Schmidt, et al. and U.S. Design application Ser. No. 29/690,697, filed May 9, 2019 for Raymond Daniel Kaualani Schmidt, which are incorporated herein by reference.

FIELD

This invention relates to stand up paddle boards and more particularly relates to a stand up paddle board with a viewing window and light ports.

BACKGROUND

Stand up paddle boards, surf boards, boogie boards and other types of floating boards typically block viewing of marine life without a user looking over an edge of the board, which can be inconvenient and may also be dangerous or may at least may allow the user to easily fall off the board.

SUMMARY

An apparatus for viewing marine life is disclosed. The apparatus includes a board configured to float on water and a window positioned in an opening in the board. The opening in a front end of the board and the window includes a transparent top portion, a transparent bottom pane and sides forming a center void. The window is sealed to prevent water from entering the void and the window includes a bottom lip planar with the transparent bottom pane extending past the sides. The apparatus includes a seal positioned in a gap between the window and the opening in the board and above the lip. The seal is inserted from a top surface of the board and provides a friction fit between the window and the opening. The seal includes a flexible resilient material and sized for a friction fit between the opening and the window to prevent movement of the window with respect to the opening.

A board configured to float on water is disclosed. The board includes an opening in the board, where the opening is in a front end of the board and the board is configured as a paddleboard. The board includes a window positioned in the opening in the board. The window includes a transparent top, and a transparent bottom pane with a lip and sides. The transparent top, the transparent bottom pane and the sides form a center void and the window sealed to prevent water from entering the void. The board includes a seal positioned in a gap between the window and the opening in the board and above the lip. The seal is inserted from a top surface of the board and provides a friction fit between the window and the opening. The seal includes a flexible resilient material and is sized for a friction fit between the opening and the window to prevent movement of the window with respect to the opening.

Another apparatus is disclosed that includes a paddleboard configured to float on water and an opening in the paddleboard where the opening is in a front end of the paddleboard. The paddleboard includes a hard shell and a soft interior where the hard shell extends to surfaces of the opening. The apparatus includes a window positioned in the opening in the paddleboard. The window includes a transparent top, a transparent bottom pane with a lip and sides. The transparent top, the transparent bottom pane and the sides form a center void and the window is sealed to prevent water from entering the void. The opening in the paddleboard includes a notch around a bottom of the opening shaped to accommodate the bottom lip of the window so a bottom surface of the transparent bottom pane is flush with a bottom of the paddleboard at a junction between the paddleboard and the window.

The apparatus includes a seal positioned in a gap between the window and the opening in the paddleboard and above the lip. The seal is inserted from a top surface of the paddleboard and provides a friction fit between the window and the opening. The seal includes a flexible resilient material and is sized for a friction fit between the opening and the window to prevent movement of the window with respect to the opening. The apparatus includes a light port extending through the paddleboard. The light port includes a lens on a bottom of the light port, the lens positioned on a bottom of the paddleboard, a tube extending through the paddleboard to the lens, a removable cap on a top of the tube, and a light removably attached to an underside of the cap.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figures 1A, 1B, 1C:
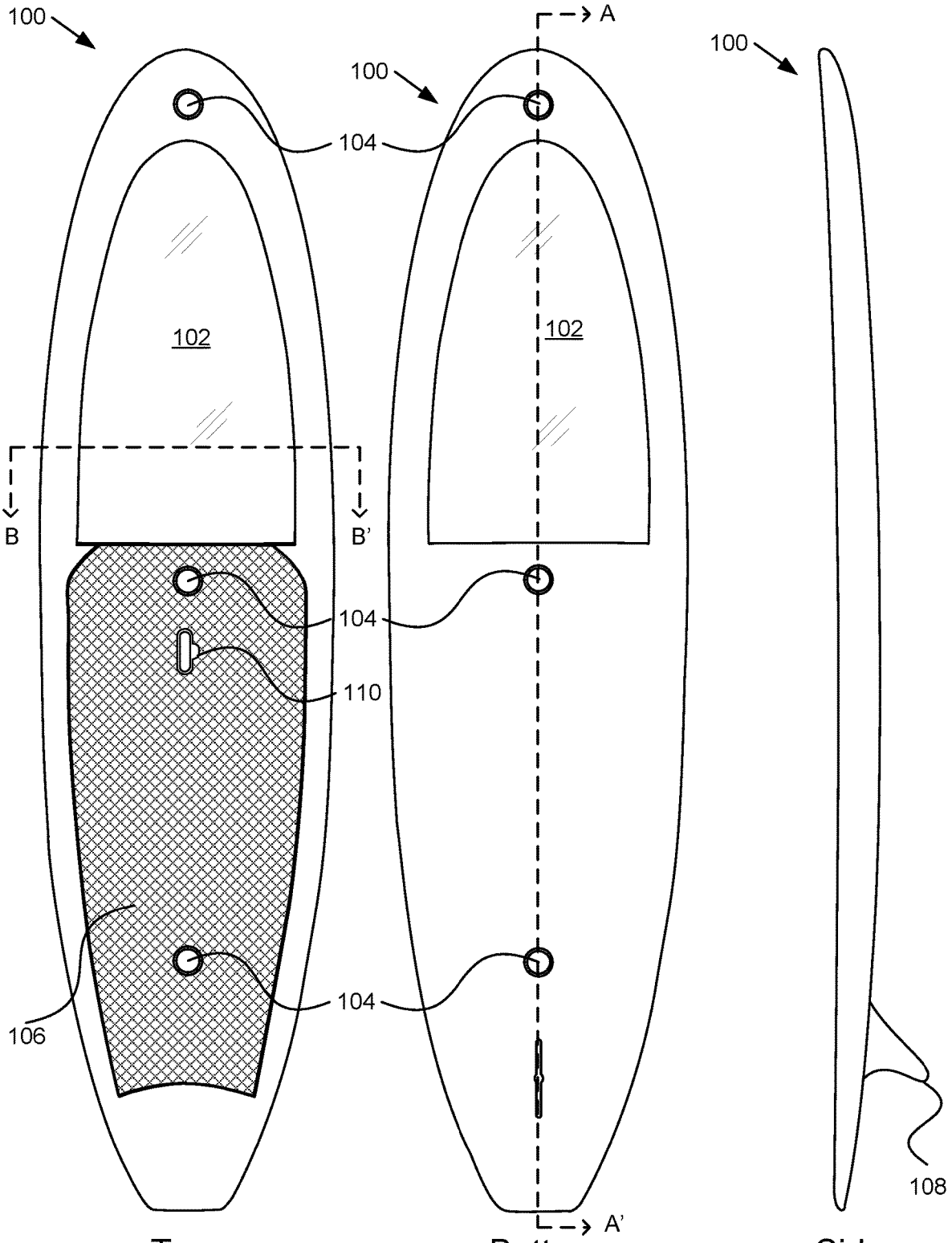
FIG. 1A is a top view illustrating one embodiment of a board with a window and light ports.
FIG. 1B is a bottom view illustrating one embodiment of a board with a window and light ports.
FIG. 1C is a side view illustrating one embodiment of a board with a window and light ports.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

As used herein, a list with a conjunction of "and/or" includes any single item in the list or a combination of items in the list. For example, a list of A, B and/or C includes only A, only B, only C, a combination of A and B, a combination of B and C, a combination of A and C or a combination of A, B and C. As used herein, a list using the terminology "one or more of" includes any single item in the list or a combination of items in the list. For example, one or more of A, B and C includes only A, only B, only C, a combination of A and B, a combination of B and C, a combination of A and C or a combination of A, B and C. As used herein, a list using the terminology "one of" includes one and only one of any single item in the list. For example, "one of A, B and C" includes only A, only B or only C and excludes combinations of A, B and C. As used herein, "a member selected from the group consisting of A, B, and C," includes one and only one of A, B, or C, and excludes combinations of A, B, and C." As used herein, "a member selected from the group consisting of A, B, and C and combinations thereof" includes only A, only B, only C, a combination of A and B, a combination of B and C, a combination of A and C or a combination of A, B and C.

An apparatus for viewing marine life is disclosed. The apparatus includes a board configured to float on water and a window positioned in an opening in the board. The opening in a front end of the board and the window includes a transparent top portion, a transparent bottom pane and sides forming a center void. The window is sealed to prevent water from entering the void and the window includes a bottom lip planar with the transparent bottom pane extending past the sides. The apparatus includes a seal positioned in a gap between the window and the opening in the board and above the lip. The seal is inserted from a top surface of the board and provides a friction fit between the window and the opening. The seal includes a flexible resilient material and sized for a friction fit between the opening and the window to prevent movement of the window with respect to the opening.

In some embodiments, the board is formed with a hard shell and a soft interior inside the hard shell. The opening is formed into the board and edges of the opening are covered with the hard shell. In other embodiments, the window is shaped with a straight side facing toward a back of the board, where the straight side is perpendicular with an axis in a direction along a length of the board from front to back, and curved sides that follow a curvature of the front of the board with a varying distance between the window and an edge of the board. In other embodiments, the opening in the board includes a notch around a bottom of the opening shaped to accommodate the bottom lip of the window so a bottom surface of the transparent bottom pane is flush with a bottom of the board at a junction between the board and the window.

In some embodiments, the window includes a transparent polycarbonate. In other embodiments, the window includes a top pane that includes the transparent top portion and sides formed over a mold and sealed to the transparent bottom pane. In other embodiments, the top pane is thermo-welded to the transparent bottom pane. In other embodiments, the seal includes a top that is wider than the gap and shaped to cover joints between the opening and the seal and the window and the seal. A vertical section of the seal that includes a bulbus shape is compressible to fit in the gap with a friction fit and with a spring force in a direction perpendicular to the gap to retain the window in the opening. In other embodiments, the seal is a flexible material.

In some embodiments, the opening is a window opening and the apparatus includes a light port. The light port includes a light opening cut into the board and extending through the board, a lens sealed to the board at a bottom of the board, a tube inserted into the opening and sealed to the lens and to the board, a removable cap shaped to fit into a top of the tube and a battery-powered light detachable from an underside of the cap and pointed toward the lens where the light is replaceable. In other embodiments, the light is magnetically attached to the underside of the cap is and is rechargeable. In other embodiments, the board includes a plurality of light ports and one of the plurality of light ports is positioned between a front edge of the board and a front edge of the window. In other embodiments, the lens is shaped to spread light passing through the lens. In other embodiments, the board includes a polypropylene shell and a foam interior where the polypropylene shell encases sides of the opening for the window. In other embodiments, the board is a stand up paddleboard.

A board configured to float on water is disclosed. The board includes an opening in the board, where the opening is in a front end of the board and the board is configured as a paddleboard. The board includes a window positioned in the opening in the board. The window includes a transparent top, and a transparent bottom pane with a lip and sides. The transparent top, the transparent bottom pane and the sides form a center void and the window sealed to prevent water from entering the void. The board includes a seal positioned in a gap between the window and the opening in the board and above the lip. The seal is inserted from a top surface of the board and provides a friction fit between the window and the opening. The seal includes a flexible resilient material and is sized for a friction fit between the opening and the window to prevent movement of the window with respect to the opening.

In some embodiments, the opening includes a notch sized to accommodate the lip. In other embodiments, the notch has a depth to accommodate a width of the lip so a bottom of the window is flush with a bottom of the board. In other embodiments, the board includes one or more light openings in the board. The light openings extend through the board in a direction from a top of the board to the bottom of the board. The one or more light openings each include a light port, each light port includes a lens on a bottom of the board, a tube extending through the light opening for the light to the lens, a cap in a top of the tube and a light removably attached to an underside of the cap.

Another apparatus is disclosed that includes a paddleboard configured to float on water and an opening in the paddleboard where the opening is in a front end of the paddleboard. The paddleboard includes a hard shell and a soft interior where the hard shell extends to surfaces of the opening. The apparatus includes a window positioned in the opening in the paddleboard. The window includes a transparent top, a transparent bottom pane with a lip and sides. The transparent top, the transparent bottom pane and the sides form a center void and the window is sealed to prevent water from entering the void. The opening in the paddleboard includes a notch around a bottom of the opening shaped to accommodate the bottom lip of the window so a bottom surface of the transparent bottom pane is flush with a bottom of the paddleboard at a junction between the paddleboard and the window.

The apparatus includes a seal positioned in a gap between the window and the opening in the paddleboard and above the lip. The seal is inserted from a top surface of the paddleboard and provides a friction fit between the window and the opening. The seal includes a flexible resilient material and is sized for a friction fit between the opening and the window to prevent movement of the window with respect to the opening. The apparatus includes a light port extending through the paddleboard. The light port includes a lens on a bottom of the light port, the lens positioned on a bottom of the paddleboard, a tube extending through the paddleboard to the lens, a removable cap on a top of the tube, and a light removably attached to an underside of the cap.

FIG. 1A is a top view, FIG. 1B is a bottom view and FIG. 1C is a side view illustrating one embodiment of a board 100 with a window 102 and light ports 104. The board 100 is configured to float on water and is configured for a person to sit, lie or stand on the board 100 while the board is floating on water, such as a lake, ocean, river, etc. In some embodiments, the board 100 is a stand up paddleboard. In other embodiments, the board 100 is a surfboard, a boogie board, or similar board.

The board 100, in some embodiments, includes a window 102 positioned in an opening in the board 100. The opening in a front end of the board 100 and the window 102 includes a transparent top portion, a transparent bottom pane and sides forming a center void. The window 102 is sealed to prevent water or other liquid from entering the void. The void may be filed with air or other gas where the gas may be of a type to prevent fogging of the window 102. The window 102 includes, in some embodiments, a bottom lip planar with the transparent bottom pane and that extending past the sides. For example, the lip extends away from the window 102 enough so that when the window 102 is place in the opening of the board 100 from a bottom of the board 100, the lip prevents the window 102 from extending into the opening past where the lip contacts the board 100.

In some embodiments, the board includes one or more light ports 104, which are configured and positioned to shine light into water under the board 100 below the board 100. The window 102 is posited at the front of the board 100 so a user standing on the board 100 can look through the window 102 while paddling without having to bend over or lay on the board 100. For example, the window 102 is configured as depicted in FIGS. 1A and 1B to closely follow a curvature of sides of the board 100. In some examples, a portion of the board 100 between sides of the board 100 and the window 102 are wide enough to structurally support the window 102 without breaking.

In some embodiments, the curvature of the window 102 is such that a light port 104 may be positioned at a front tip of the board 100 so that a distance from a front tip of the board 100 and a front tip of the window 102 is wider than a width of the board 100 between the sides of the board 100 and the window 102. A window 102 as depicted in FIGS. 1A and 1B is advantageous to view fish and other items under the board 100 without the user having to bend down or lie down on the board 100. In some embodiments, the window 102 is expanded to be as large as structural limitations of board material around the window 102 will allow.

In some embodiments, the board 100 includes other typical features of a board 100, such as a non-slip surface 106, a fin 108, an opening for a sail 110, an opening for a rope or tether (not shown), and the like. One of skill in the art will recognize other features to be included with a board 100 with a window 102 and light ports 104. Note that as used herein, a light port 104 includes components inserted and assembled into a hole in the board 100 where the device shines light down into water under the board 100 or a device that is standalone and inserted into a hole of the board 100 and includes a light to shine down into water under the board 100.

Figure 1D:
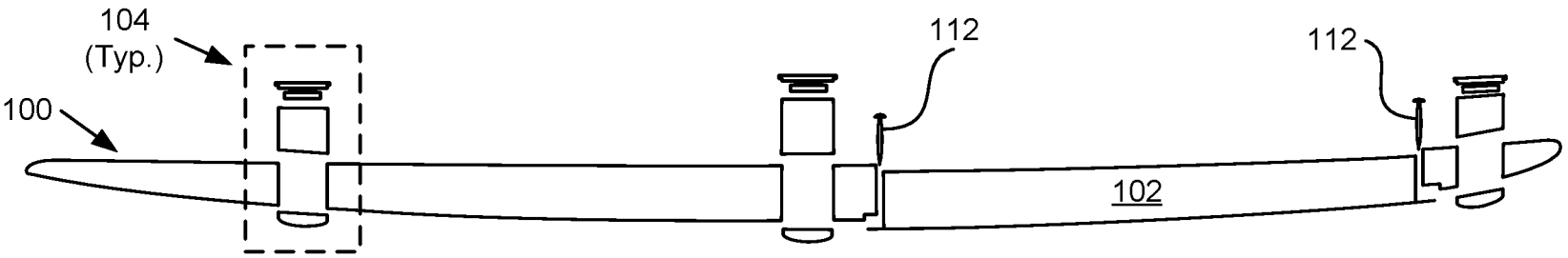
FIG. 1D is a cross section view A-A' illustrating one embodiment of a board with a window and light ports.
Figure 3:
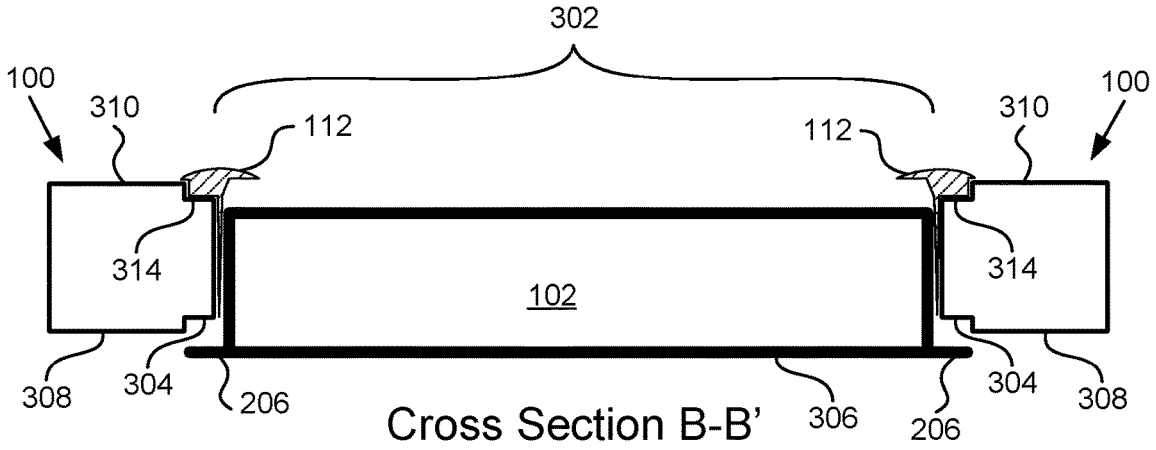
FIG. 3 is a cross section view B-B' of a window for a board with a window and light ports during installation into the board.
Figure 6:
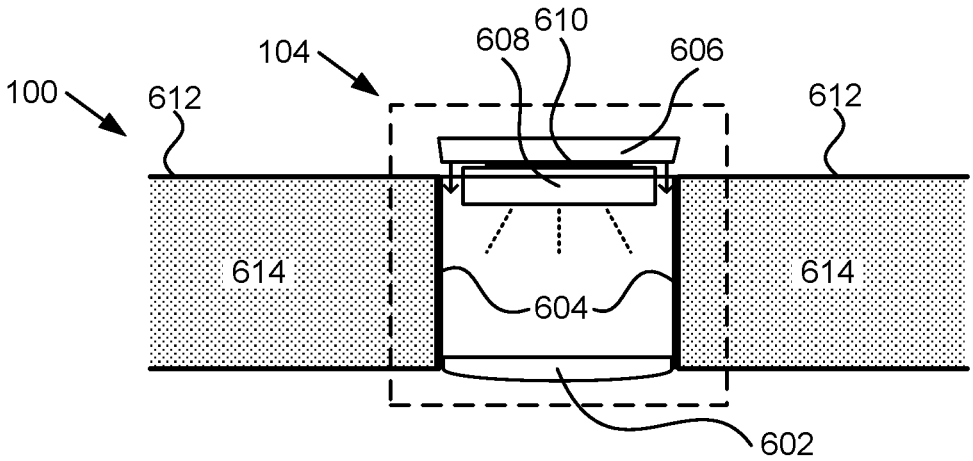
FIG. 6 is a partial cross section view of a light port in a board with a window and light ports.

FIG. 1D is a cross section view A-A' illustrating one embodiment of a board 100 with a window 102 and light ports 104 as depicted in FIGS. 1A, 1B and 1C. In some embodiments, the board 100 includes a seal 112 positioned in a gap between the window 102 and the opening in the board 100 and above the lip. A more detailed view of the window 102 and seal 112 are depicted in FIG. 3. A more detailed view of the light port 104 is depicted in FIG. 6. In some embodiments, the seal 112 is inserted from a top surface of the board 100 and provides a friction fit between the window 102 and the opening. In some embodiments, the seal 112 includes a flexible resilient material and is sized for a friction fit between the opening and the window 102 to prevent movement of the window 102 with respect to the opening.

Figure 2A:
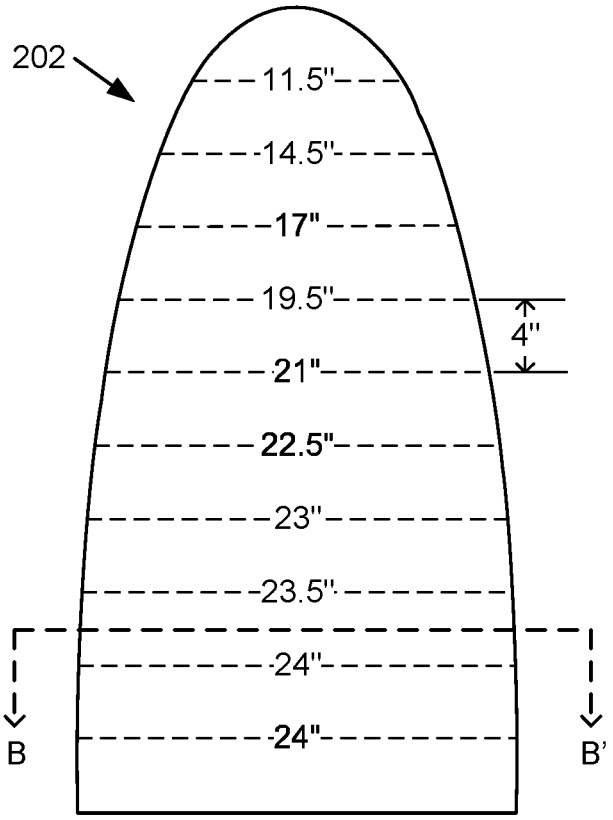
FIG. 2A is a top view of a bottom pane of a window for a board with a window and light ports.
Figure 2B:
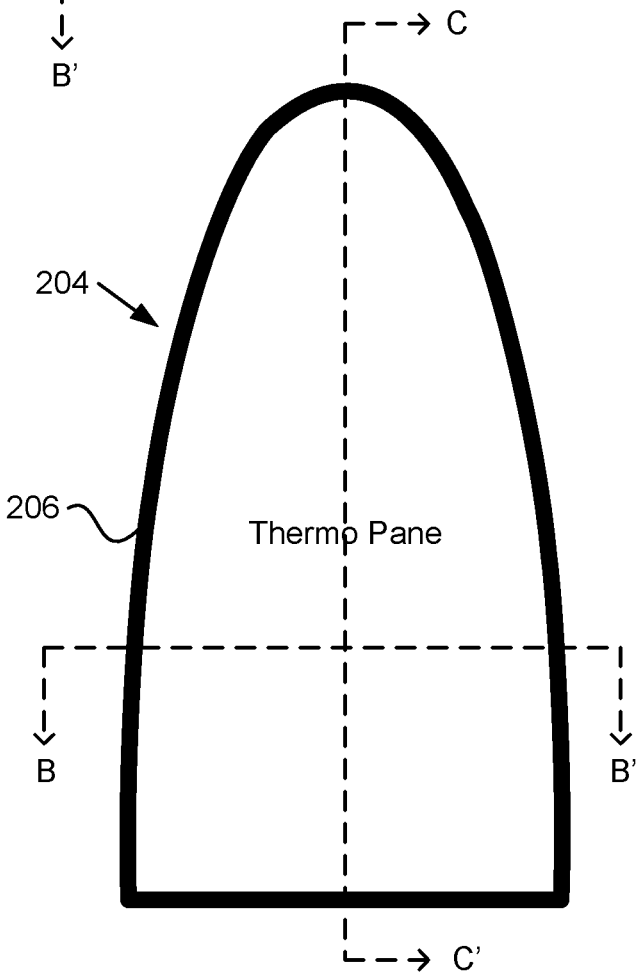
FIG. 2B is a top view of a top pane of a window for a board with a window and light ports.

FIG. 2A is a top view of a bottom pane 202 of a window for a board 100 with a window 102 and light ports 104 and FIG. 2B is a top view of a top pane 204 (top thermo pane) of a window 102 for a board 100 with a window 102 and light ports 104. The bottom pane 202 is configured to fit together with the top pane 204 and extend past edges of an opening in the board 100 with a lip 206. In the depicted embodiment of FIG. 2A, dimensions are shown with the horizontal lines depicting widths at a 4 inch spacing. Other embodiments will have different dimensions and the dimensions depicted are not to be construed as limiting.

Note that the general shape of the top pane 204 and the bottom pane 202 match a shape of a front of the board 100 except the top of the top pane 204 and bottom pane 202 are angled differently from the top of the board 100 to accommodate a light port 104. In other embodiments, the top pane 204 and bottom pane 202 are shaped to maintain a particular width between the window 102 and edges of the board 100 so that board material surrounding the window 102 is large enough to provide structural strength sufficient to support the window 102.

Figure 2C:
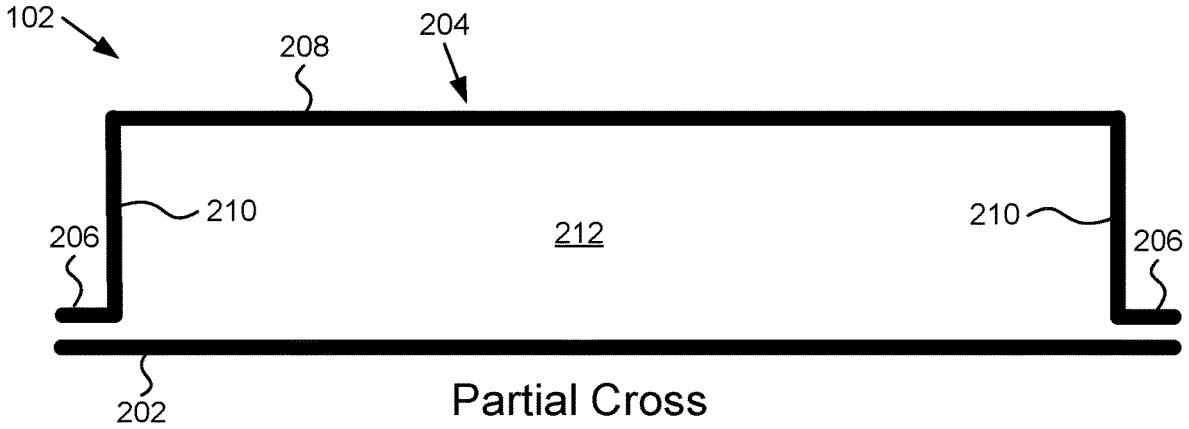
FIG. 2C is a partial cross section view B-B' of the bottom pane and the top pane of the window for a board with a window and light ports of FIGS. 2A and 2B in a state before connection.

Edges of the top pane 204 are depicted as thicker than the edges of the bottom pane 202 to illustrate that the top pane 204 is formed with a top portion 208 and sides 210 and a lip 206, as depicted in FIG. 2C. FIG. 2C is a partial cross section view B-B' of the bottom pane 202 and the top pane 204 of the window 102 for a board 100 with a window 102 and light ports 104 of FIGS. 2A and 2B in a state before connection. The lip 206 formed with the top pane 204, in one embodiment, provides a surface to connect to the bottom pane 202. In other embodiments, the top pane 204 includes a top portion 208 and vertical sides 210 without a lip 206 and a bottom edge of the sides 210 connect to the bottom pane 202.

In one embodiment, the top pane 204 is constructed using a sheet of material that is heated and placed on a mold so that the sheet melts and forms sides 210 and the lip 206. In some embodiments, the mold includes a top with a curvature so the top portion 208 of the top pane 204 has a top portion 208 that is curved. In the embodiment, the top portion 208 of the top pane 204 matches a curvature of a front part of the board 100 to be flush across the top of the board 100. In other embodiments, a front of the board 100 is flat and the top portion 208 of the top pane 204 is flat. In other embodiments, the top portion 208 of the top pane 204 is not flush with a top of the board 100.

In some embodiments, the top pane 204 is polycarbonate. In other embodiments, the top pane 204 is another clear material that is capable of being melted over a mold. In other embodiments, the top pane 204 is constructed another way, such as a clear liquid material being poured into a mold, the top pane 204 is cut out of block of material, etc. In other embodiments, the top pane 204 is constructed by forming sides 210 and/or the lip 206 separate from the top portion 208 and the top portion 208 is connected to the sides 210 and the sides 210 may also be connected to the lip 206. The top pane 204 may be any clear material formed with any suitable construction technique. One of skill in the art will recognize other ways to form the top pane 204, including construction techniques without using heat. The bottom pane 202, in some embodiments, is polycarbonate. In other embodiments, the bottom pane 202 is glass, acrylic or other material. In some embodiments, the top pane 204 and bottom pane 202 are of a same material.

In some embodiments, the top pane 204 is connected to the bottom pane 202 using a method that seals the top pane 204 to the bottom pane 202 so that water doesn't enter a void 212 formed between the panes 202, 204. In some embodiments, the void 212 is dried to prevent condensation from forming on the panes 202, 204. In other embodiments, the void 212 is filled with a gas other than air.

In some embodiments, the panes 202, 204 are thermo-welded together. For example, where the panes 202, 204 are polycarbonate, the panes 202, 204 are thermo-welded with a polycarbonate thermo-weld process. In other embodiments, the panes 202, 204 are glued together with an appropriate glue or silicone seal. One of skill in the art will recognize other ways to seal the panes 202, 204 together to prevent water from entering the void 212 formed between the panes 202, 204.

FIG. 3 is a cross section view B-B' of a window 102 for a board 100 with a window 102 and light ports 104 during installation into the board 100. The window 102 is inserted in an opening 302 in the board 100 from under the board 100. In the embodiment, the board 100 includes a notch 304 around a bottom of the opening 302 shaped to accommodate the bottom lip 206 of the window 102. In other embodiments, the opening 302 does not include a notch and the lip 206 fits against a bottom surface 308 of the board 100. In some embodiments, a bottom surface of the transparent bottom 306 is flush with a bottom 308 of the board 100 at a junction between the board 100 and the window 102. In other embodiments, the bottom of the window 102 is not flush with the board 100.

The lip 206 provides a stop for the window 102 so that the window 102 does not push into the opening 302 past where the lip 206 engages the notch 304, which provides support for the window 102 to prevent the window 102 from pushing up too far. A seal 112 is positioned in a gap between the window 102 and the opening 302 in the board 100 and above the lip 206. In some embodiments, the seal 112 is inserted from a top surface 310 of the board 100. In some embodiments, the seal 112 provides a friction fit between the window 102 and the opening 302.

In some embodiments, the seal 112 includes a flexible resilient material. The seal 112, in other embodiments, is sized for a friction fit between the opening 302 and the window 102 to prevent movement of the window 102 with respect to the opening 302. For example, the seal 112 may be made of rubber, vinyl, high density foam, nitrile, or similar material that is resilient such that the material springs back to an original form after being compressed and thus exerts a force in a direction of the compression. In addition, the seal 112 includes a surface with a coefficient of friction that impedes sliding with respect to the window 102 and/or hard shell of the opening 302 of the board 100. For example, the seal 112 is not slippery with respect to the window 102 and opening 302, but instead resists slippage.

In other embodiments, the window 102 and or opening 302 includes notches (not shown) or other locking mechanism where the seal 112 is positioned in the notches to retain the window 102 in place. In one example, a ring (not shown) is secured over the gap, a portion of the window 102 and a portion of the board 100 and is secured to the board 100 and may also be secured to the window 102. In some examples, the window 102 inserts into the opening 302 with a friction fit, which affects use of a seal 112 or other method to secure the window 102 into the opening 302 of the board 100. For example, the ring may be secured using screws. In some embodiments, the ring includes a material on a side against the board 100 and window 102, such as rubber, high density foam, etc. that seals the gap and prevents water from entering between the opening 302 and window 102. One of skill in the art will recognize other ways to secure the window 102 into the opening 302 of the board 100.

In the embodiment of FIG. 3, the opening 302 includes a notch 314 at a top of the opening 302 to accommodate the seal 112. The notch 314 at the top of the opening 302, in some embodiments, helps to retain the seal 112 and/or to keep the seal 112 from being pushed too far into the gap between the window 102 and opening 302, which may allow a top cap of the seal 112 to be smaller and/or more flush than without the notch 314. For example, the seal 112 may have a top that is flush with a top of the window 102 and/or top surface 310 of the board 100. In other embodiments, a top cap of the seal 112 is sized to keep the seal 112 from pushing too far into the gap between the window 102 and the opening 302. In the embodiment, the top cap of the seal 112 is rigid enough and includes enough material to prevent the seal 112 from pushing into the gap too far, to be strong enough to withstand walking on the seal 112, pushing on the seal 112, etc.

In one embodiment, the seal 112 includes a bulbus shape that allows the seal 112 to be compressed and then to exert a force against the window 102 and the opening 302 of the board 100. In one embodiment, the bulbus portion of the seal 112 is hollow to allow the seal 112 to be compressed. In other embodiments, the bulbus portion of the seal 112 is solid, but is made to be compressed. For example, the seal 112 may be of a rubber, vinyl, high density foam, etc. that deforms to accommodate compression. One of skill in the art will recognize other ways for the seal 112 to be compressed to fit in the gap between the window 102 and the opening 302 and then to provide a force against the window 102 and opening 302 to prevent movement of the window 102.

Figure 4:
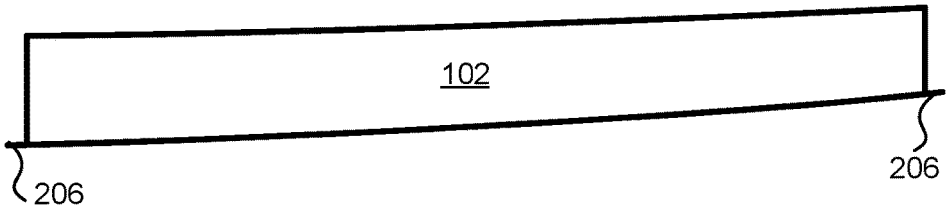
FIG. 4 is a cross section view C-C' of the assembled window with the bottom pane and top pane of FIGS. 2A and 2B.

FIG. 4 is a cross section view C-C' of the assembled window 102 with the bottom pane 202 and top pane 204 of FIGS. 2A and 2B. The cross section view C-C' illustrates one embodiment where the window 102 is curved.

Figure 5:
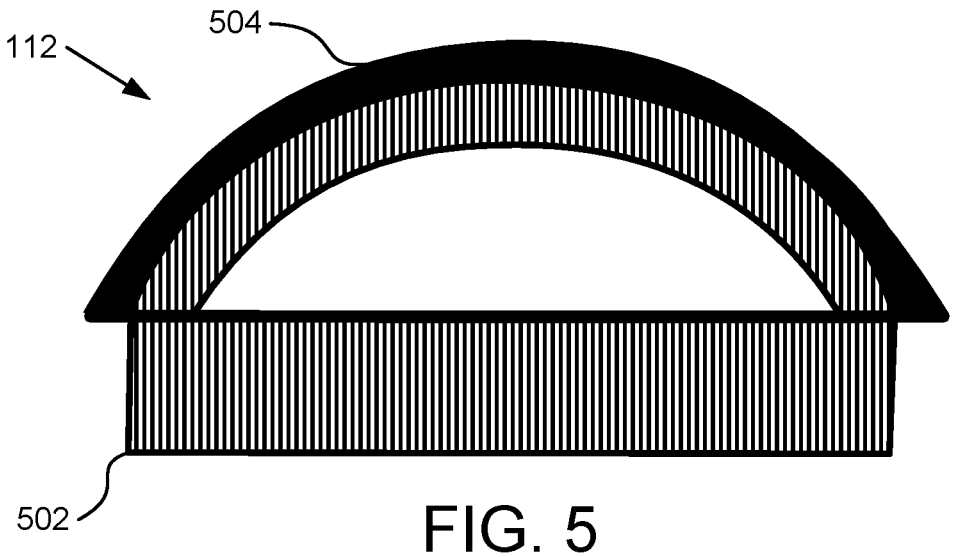
FIG. 5 is a perspective view of a seal for a window in a board with a window and light ports.

FIG. 5 is a perspective view of a seal 112 for a window in a board 100 with a window 102 and light ports 104. The seal 112 includes a top cap 504 and a lower portion 502 that extends into the gap between the window 102 and opening 302 of the board 100. In the embodiment, the seal 112 is depicted as continuous. In other embodiments, the seal 112 includes a vertical cut that may facilitate easier insertion, easier shipping, etc. In some embodiments, a straight portion of the seal 112 that corresponds to the straight portion of the opening 302 and window 102 is one piece and the curved portion of the seal 112 corresponding to the curved portion of the opening 302 and window 102 is a separate piece and the top cap 504 is cut during installation to fit together. Having two pieces for the seal 112 is advantageous for shipping because the seal 112 can be laid flat. One of skill in the art will recognize other options for shaping the seal 112 for convenience of shipping, installation, etc.

FIG. 6 is a partial cross section view of a light port 104 in a board 100 with a window 102 and light ports 104. The light port 104 includes a lens 602, a tube 604, a cap 606, a light 608, and a connector 610, which are described below.

The light port 104 includes a lens 602 sealed to the board 100 at a bottom of the board 100. In some embodiments, the lens 602 spreads light received from a light 608 above the lens 602. In some examples, the lens 602 is shaped to direct light outward rather than straight down. The lens 602, in some embodiments, is a Fresnel lens or similar. In other embodiments, the lens 602 is a lens that is typically used in a spa, pool, hot tub, etc. and is made for underwater use. One of skill in the art will recognize other types of lenses that may be used as the lens 602 of the light port 104.

In one embodiment, the lens 602 is sealed to the bottom of the board 100, for example with silicon seal, glue, etc. In another embodiment, the lens 602 is sealed to the tube 604. In another embodiment, the lens 602 is sealed to the bottom of the board 100 and to the tube 604 to prevent water from entering the tube 604 and/or material 614 inside a hard shell 612 of the board 100. In some embodiments, the lens 602 is round. In other embodiments, the lens 602 is another shape, such as a square, an oval, etc. Typically, the lens 602 and the tube 604 have a same shape at an end where the lens 602 attached to the tube 604. In some embodiments, the lens 602 is made of a clear material. In other embodiments, the lens is made of a translucent material. In other embodiments, a shape of the lens 602, such as a Fresnel lens, causes the lens to appear not completely clear.

A round lens 602 and tube 604 facilitates cutting a round hole in the board 100 for the light port 104 that forms a light opening for the light port 104. The light opening, in some embodiments, extends through the board 100. In other embodiments, the light opening extends part way through the board 100 from a bottom of the board 100. In the embodiment, the light port 104 may be inserted from the bottom and may be stand-alone light. The light port 104, in the embodiment, is accessible from the bottom to get to a light in the light port 104. In some embodiments, the board 100 is formed with a hard shell 612 and then one or more light openings for light ports 104 are cut after the board 100 is formed. In another embodiment, the board 100 is formed with light openings for the light ports 104. In the embodiment, the light openings for the light ports 104 are formed with a hard shell 612 in the light opening. In another embodiment, the light openings for the light ports 104 are formed with interior board material 614 exposed to the light openings. One of skill in the art will recognize other ways to form a light opening and advantages and disadvantages of each method of forming a light opening.

The tube 604, in some embodiments is sealed to the lens 602 and to the board 100. For example, the tube 604 may be sealed with silicone seal, glue, thermo-weld, or other material/method that secures the tube 604 to the board and prevents water from entering internal material 614 of the board 100. In some embodiment, the tube 604 is cylindrical. For example, the tube 604 may be constructed from a piece of pipe, such as a polyvinyl chloride ("PVC") pipe. In other embodiments, the tube 604 is made from pipe of another material. In other embodiments, the tube 606 is made from another type of material, such as plastic, metal, etc.

The light port 104 includes a cap 606. In some embodiments, the cap 606 is removable. In some embodiments, the cap fits in the tube 606 with a friction fit. In other embodiments, the cap 606 screws into the tube 604. In other embodiments, the cap 606 is secured to the tube 604 with one or more fasteners. For example, the fasteners may be screws. One of skill in the art will recognize various ways to secure the cap 606 to the tube 604. In some embodiments, the cap 606 fits flush with a top surface of the board 100. For example, the cap may include a pull ring, a handle or other mechanism to grab the flush cap 606. In other embodiments, the cap 606 protrudes above a top surface of the board 100.

In various embodiments, the light port 104 includes a light 608 that connects to an underside of the cap 606. In some examples, the light 608 is a battery-powered light. In some embodiments, the light 608 is rechargeable. In other embodiments, the light 608 is powered by replaceable batteries. In some embodiments, the light 608 includes one or more light-emitting diodes ("LEDs"). In another embodiment, the light 608, includes an incandescent source, a fluorescent source, etc. In some embodiments, the light 608 is water resistant.

The light 608 is connected to the underside of the cap 606. In one embodiment, the light 608 is connected with a connector 610. In some embodiments, the connector 610 includes a magnet. For example, the light 608 includes a magnet and the cap 606 includes a piece of metal, or vice-versa. In another embodiment, the light 608 and cap 606 each include a magnet. In other embodiments, the connector 610 securing the light 608 to the cap 606 includes a bracket, double-sided tape, screws, or other attachment means known to one of skill in the art. In some embodiments, the light 608 is detachable from the cap 606. For example, when the light 608 is detachable from the cap 606, the light 608 may be removed and recharged or may have batteries changed.

In other examples, the light 608 includes replaceable battery packs so that a user may change out a discharged battery pack with a charged battery pack. In the embodiments, the user may take one or more lights 608 and/or one or more charged battery packs to exchange while the board 100 is in use. In other embodiments, the board 100 includes a battery compartment (not shown) with wires running to the lights 608 and a user may replace batteries in the battery compartment to run lights 608 in the light ports 104.

In some embodiments, the board 100 includes two or more light ports 104 strategically positioned in the board 100 to allow viewing of fish and other marine life through the window 102 and illuminated by lights 608 in the light ports 104. In other embodiments, each light port 104 or a portion of a light port 104 (e.g. the tube 604, cap 606, light 608 and connector 610) is removable as a unit. For example, the light port 104 may fit in the light opening in such a way as to prevent water from reaching interior material 614 of the board 100. One of skill in the art will recognize other ways to construct a light port 104.

The board 100 includes a window 102 that is optimized for viewing marine life below the board 100 and one or more light ports 104 to illuminate water under the board 100. The window 102 is easily replaceable as a unit, which is convenient for users. The light ports 104 provide an easy way to replace lights 608 for extended viewing.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a board configured to float on water;

a window positioned in an opening in the board, the opening in a front end of the board, the window comprising a transparent top portion, a transparent bottom pane and sides forming a center void, the window sealed to prevent water from entering the void, the window comprising a bottom lip planar with the transparent bottom pane extending past the sides, the window forming a sealed unit separate from the board; and a seal positioned in a gap between the window and the opening in the board and above the lip, wherein the seal is inserted from a top surface of the board and provides a friction fit between the window and the opening, the seal comprising a flexible resilient material and sized for a friction fit between the opening and the window to prevent movement of the window with respect to the opening.

2. The apparatus of claim 1, wherein the board is formed with an exterior shell and an interior inside the shell comprising a material different than the shell, wherein the opening is formed into the board and a surface of the opening is covered with the shell.

3. The apparatus of claim 1, wherein the window is shaped with a straight side facing toward a back of the board, the straight side perpendicular with an axis in a direction along a length of the board from front to back, and curved sides that follow a curvature of the front of the board with a varying distance between the window and an edge of the board.

4. The apparatus of claim 1, wherein the opening in the board comprises a notch around a bottom of the opening shaped to accommodate the bottom lip of the window so a bottom surface of the transparent bottom pane is flush with a bottom of the board at a junction between the board and the window.

5. The apparatus of claim 1, wherein the window comprises a transparent polycarbonate.

6. The apparatus of claim 1, wherein the window comprises a top pane comprising the transparent top portion and sides formed over a mold and sealed to the transparent bottom pane.

7. The apparatus of claim 6, wherein the top pane is thermo-welded to the transparent bottom pane.

8. The apparatus of claim 1, wherein the seal comprises a top that is wider than the gap and shaped to cover joints between the opening and the seal and the window and the seal, and a vertical section comprising a bulbus shape compressible to fit in the gap with a friction fit and with a spring force in a direction perpendicular to the gap to retain the window in the opening.

9. The apparatus of claim 1, wherein the seal comprises a flexible material.

10. The apparatus of claim 1, wherein the opening is a window opening and further comprising a light port comprising:

a light opening cut into the board and extending through the board;

a lens sealed to the board at a bottom of the board;

a tube inserted into the opening and sealed to the lens and to the board;

a removable cap shaped to fit into a top of the tube; and a battery-powered light detachable from an underside of the cap and pointed toward the lens, wherein the light is replaceable.

11. The apparatus of claim 10, wherein the light is magnetically attached to the underside of the cap is and is rechargeable.

12. The apparatus of claim 10, wherein the board comprises a plurality of light ports and one of the plurality of light ports is positioned between a front edge of the board and a front edge of the window.

13. The apparatus of claim 10, wherein the lens is shaped to spread light passing through the lens.

14. The apparatus of claim 1, wherein the board comprises a polypropylene shell and a foam interior, the polypropylene shell encasing sides of the opening for the window.

15. The apparatus of claim 1, wherein the board is a stand up paddleboard.

16. A board configured to float on water, the board comprising:

an opening in the board, the opening in a front end of the board, the board configured as a paddleboard;

a window positioned in the opening in the board, the window comprising a transparent top portion, a transparent bottom pane with a lip and sides, wherein the transparent top portion, the transparent bottom pane and the sides form a center void and the window sealed to prevent water from entering the void, the window forming a sealed unit separate from the board; and a seal positioned in a gap between the window and the opening in the board and above the lip, wherein the seal is inserted from a top surface of the board and provides a friction fit between the window and the opening, the seal comprising a flexible resilient material and sized for a friction fit between the opening and the window to prevent movement of the window with respect to the opening.

17. The board of claim 16, wherein the opening comprises a notch sized to accommodate the lip.

18. The board of claim 17, wherein the notch has a depth to accommodate a width of the lip so a bottom of the window is flush with a bottom of the board.

19. The board of claim 16, further comprising one or more light openings in the board, the light openings extending through the board in a direction from a top of the board to the bottom of the board, the one or more light openings each comprising a light port, each light port comprising:

a lens on a bottom of the board;

a tube extending through the light opening for the light to the lens;

a cap in a top of the tube; and a light removably attached to an underside of the cap.

20. An apparatus comprising:

a paddleboard configured to float on water, an opening in the paddleboard, the opening in a front end of the paddleboard, the paddleboard comprising a hard shell and a soft interior, the hard shell extends to surfaces of the opening;

a window positioned in the opening in the paddleboard, the window comprising a transparent top portion, a transparent bottom pane with a lip and sides, the transparent top portion, the transparent bottom pane and the sides forming a center void, the window sealed to prevent water from entering the void, the opening in the paddleboard comprises a notch around a bottom of the opening shaped to accommodate the bottom lip of the window so a bottom surface of the transparent bottom pane is flush with a bottom of the paddleboard at a junction between the paddleboard and the window;

a seal positioned in a gap between the window and the opening in the paddleboard and above the lip, wherein the seal is inserted from a top surface of the paddleboard and provides a friction fit between the window and the opening, the seal comprising a flexible resilient material and sized for a friction fit between the opening and the window to prevent movement of the window with respect to the opening; and a light port extending through the paddleboard, the light port comprising a lens on a bottom of the light port, the lens positioned on a bottom of the paddleboard, a tube extending through the paddleboard to the lens, a removeable cap on a top of the tube, and a light removably attached to an underside of the cap.

* * * * *